United States Patent [19]

Russo

[11] Patent Number: 4,516,050

[45] Date of Patent: May 7, 1985

[54] ION CHAMBER FOR ELECTRON-BOMBARDMENT ION SOURCES

[75] Inventor: Carl J. Russo, Ipswich, Mass.

[73] Assignee: Varian Associates, Inc., Palo Alto, Calif.

[21] Appl. No.: 397,962

[22] Filed: Jul. 14, 1982

[51] Int. Cl.[3] ..... H01J 1/50; H05H 1/00

[52] U.S. Cl. ..... 313/359.1; 313/362.1; 313/154; 313/155; 60/202

[58] Field of Search ..... 313/359.1, 360.1, 361.1, 313/362.1, 153, 154, 155, 156, 158, 159, 160, 161, 162; 60/202; 156/345; 250/427

[56] References Cited

U.S. PATENT DOCUMENTS

| | | | |
|---|---|---|---|
| 3,156,090 | 11/1964 | Kaufman | 60/35.5 |
| 3,969,646 | 7/1976 | Reader et al. | 313/359 |
| 4,126,781 | 11/1978 | Siegel | 250/305 |
| 4,158,589 | 6/1979 | Keller et al. | 156/345 |
| 4,259,145 | 3/1981 | Harper et al. | 156/643 |
| 4,277,939 | 6/1981 | Hyman, Jr. | 60/202 |

OTHER PUBLICATIONS

Ramsey, "12-cm Magneto-Electrostatic Containment Mercury Ion Thruster Development," *J. Spacecraft and Rockets*, vol. 9, pp. 318-321, (1972).

Kaufman et al., "Ion Sources for Machining Applications," AIAA Paper No. 76-1014, (1976).

Reader et al., "Optimization of an Electron-Bombardment Ion Source for Ion Machining Applications," *J. Vac. Sci. Technol.*, vol. 12, No. 6, Nov./Dec. 1975.

Issacson et al., "15-cm Multipole Gas Ion Thruster," AIAA Paper No. 76-1045, (1976).

Ion Tech, Inc. data sheet, "2.5 cm (Standard or High Power), 10 cm and 15 cm Ion Sources," date unknown.

*Primary Examiner*—Leo H. Boudreau
*Assistant Examiner*—K. Wieder
*Attorney, Agent, or Firm*—Stanley Z. Cole; William R. McClellan

[57] ABSTRACT

A multipole electron-bombardment type ion source includes an ion chamber defined by chamber walls and magnetic elements of an electrically insulating, permanently magnetized material. The magnetic elements provide mechanical support for anode elements and electrically isolate the anode elements from the chamber walls. In a preferred embodiment, the magnetic elements and the anode elements form a layered structure.

9 Claims, 3 Drawing Figures

ION CHAMBER FOR ELECTRON-BOMBARDMENT ION SOURCES

DESCRIPTION

Background of the Invention

This invention relates to electron-bombardment ion sources and, more particularly, to new and improved ion chambers for electron-bombardment ion sources.

Electron-bombardment ion sources of the so-called Kaufman type were initially developed for spacecraft propulsion. See, for example, U.S. Pat. No. 3,156,090, issued Nov. 10, 1961 to Kaufman. More recently, such ion sources have been used in ion beam milling and reactive ion beam etching applications. See, for example, U.S. Pat. No. 4,259,145, issued Mar. 31, 1981, to Harper et al. Ion sources of this type are characterized by a relatively broad ion beam output.

Kaufman ion sources typically include an ion chamber in which electrons, emitted by a cathode, are accelerated toward one or more anode elements and cause ionization of a gas. The ionization efficiency of the ion source is increased by the application of a magnetic field which confines the electrons to the central discharge portion of the ion chamber thereby increasing the number of ionizing collisions experienced by each electron. The anodes and magnets are positioned near the walls of the ion chamber to provide a relatively large discharge region. Ions are extracted from one end of the ion chamber by an accelerator electrode.

A preferred ion chamber geometry utilizes magneto-electrostatic containment of the ions and electrons in the discharge region of the ion chamber. See Ramsey, "12-cm Magneto - Electrostatic Containment Mercury Ion Thruster Development," *J. Spacecraft and Rockets,* Vol. 9, pp. 318–321 (1972). An array of magnetic pole strips are positioned along the walls of the ion chamber. Between each pair of magnetic pole strips is positioned an anode strip eletrically isolated from the magnets. Such configurations provide high efficiency operation by keeping the plasma off the walls of the ion chamber.

In a typical multipole ion source configuration according to the prior art, multiple stainless steel anodes are positioned between ferritic stainless steel pole pieces. Alnico permanent magnets provide a magnetic field. The pole pieces are supported in the ion chamber by attachment to the wall thereof. Since the ion chamber wall and the anodes are maintained at different potentials during operation, electrical isolation between these elements is required. In a commercially available 15 centimeter ion source, six anodes are supported in the ion chamber and are coupled to a power source by 56 feedthrough assemblies. While such a configuration provides generally satisfactory operation, it is expensive to manufacture because of the large number of parts and the time required to assemble those parts. The construction also causes difficulty in the cleaning and servicing of the ion source. Buildup of deposits in the ion chamber during operation necessitates frequent cleaning of the ion source. The large number of parts in the unit makes disassembly, cleaning, repair and reassembly a time-consuming and costly task.

In another approach, conductive magnets support anodes of electrically conductive magnetic material. See U.S. Pat. No. 3,969,646 issued July 13, 1976 to Reader et al and Kaufman et al, "Ion Sources for Machining Applications," AIAA Paper No. 76-1014 (1976). The entire assembly of magnets and anodes requires electrical isolation from the walls of the ion chamber. Thus, the requirement for insulating supports is reduced but not eliminated.

When ion sources with stainless steel pole pieces and anodes are used with carbon-containing halogen gases, such as $CCl_4$, undesirable sputtering of the stainless steel onto the target occurs. Fortunately, carbon is thermally disassociated from the $CCl_4$ prior to ionization and precipitates onto the cooler surfaces of the source where it forms a protective coating. However, the protective coating continues to build up and requires cleaning at periodic intervals. Furthermore, in spite of the protective coating, the stainless steel corrodes when the ion chamber is opened to the air.

It is a general object of the present invention to provide new and improved electron-bombardment ion sources.

It is another object of the present invention to provide an improved ion source having a simple ion chamber construction.

It is still another object of the present invention to provide an improved ion source having anodes which are less subject to sputtering and corrosion during operation.

SUMMARY OF THE INVENTION

According to the present invention, these and other objects and advantages are achieved in a novel electron-bombardment ion source comprising an ion chamber defined by electrically conductive chamber walls, a cathode for emitting electrons, anode means in the ion chamber for accelerating and collecting electrons and magnetic means in the ion chamber for producing a magnetic field which increases the ionization efficiency of the ion source. The magnetic means comprises an electrically insulating, permanently magnetized material configured to provide mechanical support for the anode means and to electrically isolate the anode means from the chamber walls. The ion source further comprises means for introducing an ionizable gas into the chamber and means for accelerating ions out of the chamber. In one embodiment, the anode means includes a plurality of annular anode elements, and the magnetic means includes portions interposed between the anode elements so as to form a layered structure which is positioned in a cylindrical ion chamber. According to another aspect of the present invention, the anode means comprises graphite.

BRIEF DESCRIPTION OF THE DRAWINGS

For a better understanding of the present invention, together with other and further objects, advantages and capabilities thereof, reference may be had to the accompanying drawings which are incorporated herein by reference and in which.

DESCRIPTION OF THE PRIOR ART

Figure 1:
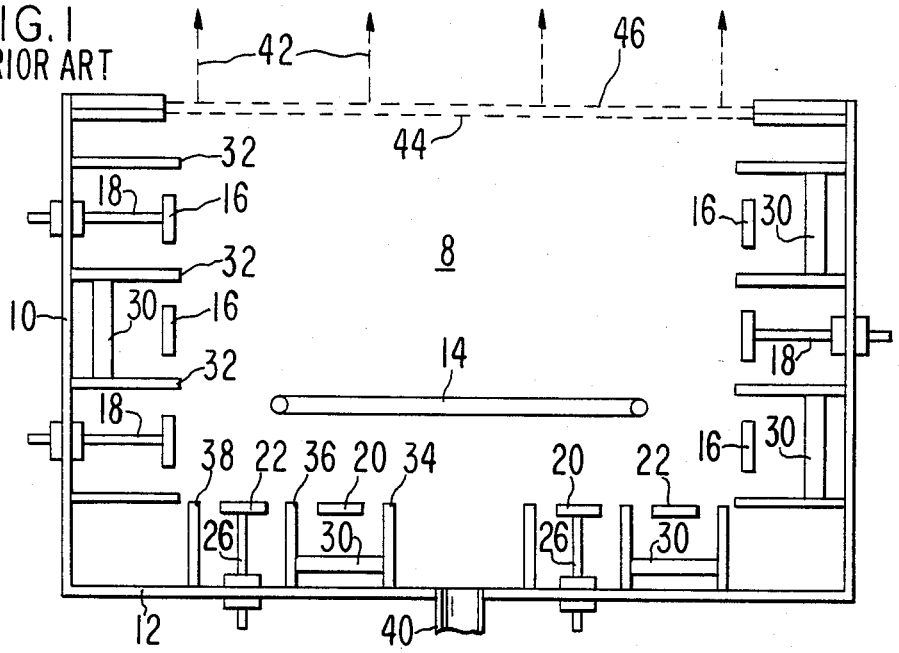
FIG. 1 PRIOR ART
FIG. 1 is a cross-sectional view of an ion source in accordance with the prior art.

A multipole ion source according to the prior art is shown in FIG. 1. An ion chamber 8 is formed by a cylindrical wall 10 and an end wall 12. A cathode 14, which emits electrons when coupled to a power source, is located in the central portion of the ion chamber 8. A plurality of annular anodes 16 are supported adjacent to the cylindrical wall 10 by feedthroughs 18. Additional annular anodes 20, 22 are supported adjacent to the end wall 12 by feedthroughs 26. Alnico permanent magnets 30 and associated ferritic stainless steel pole pieces 32, 34, 36, 38 provide a magnetic field in the region of the anodes 16, 20, 22 which is generally parallel to the walls 10, 12 of the ion chamber 8. A gas feed 40 introduces an ionizable gas into the ion chamber 8 through the end wall 12. An ion beam 42 is extracted from the ion chamber 8 through a screen grid 44 and an accelerator grid 46.

Feedthroughs 18, 26, in addition to providing mechanical support for the anodes 16, 20, 22, provide an electrical connection between the anodes 16, 20, 22 and an external power source. The electrical connection is isolated from the wall of the ion chamber by an insulator. Two stainless steel shields enclose the insulator and protect it against buildup of deposits and electrical tracking. While FIG. 1 shows five feedthroughs 18, 26, it is to be understood that numerous feedthroughs are utilized around the walls 10, 12 to support the anodes 16, 20, 22. When the ion source is disassembled for cleaning, each feedthrough must be disassembled and the two stainless steel shields cleaned.

DETAILED DESCRIPTION OF THE INVENTION

Figure 2:
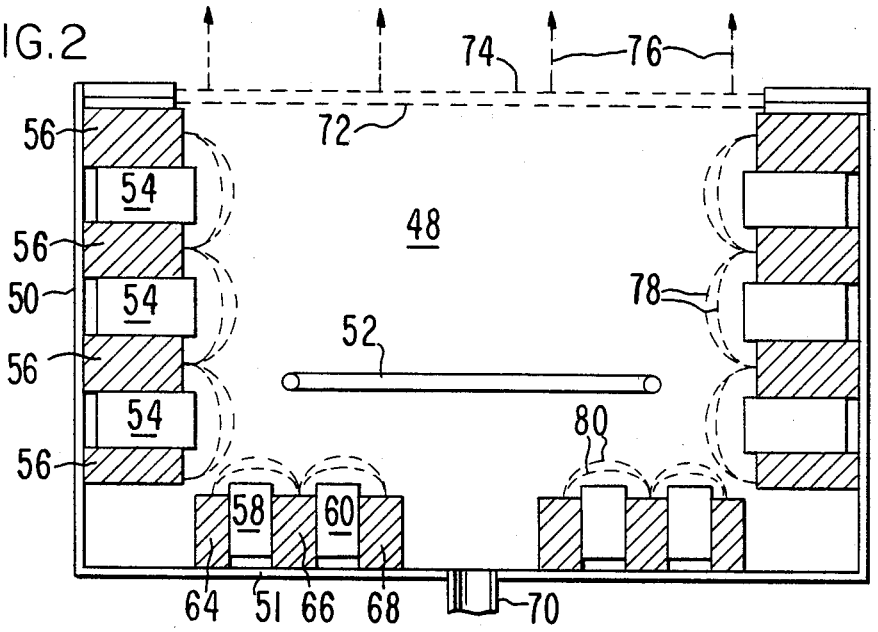
FIG. 2 is a cross-sectional view of an ion source in accordance with the present invention.

An ion source in accordance with the present invention is shown in simplified form in FIG. 2. An ion chamber 48 is formed by a cylindrical wall 50 and an end wall 51. A cathode 52 is located in the central portion of the ion chamber 48. A plurality of annular anodes 54 is supported adjacent to the cylindrical wall 50 by a plurality of insulating magnetic elements 56. Additional annular anodes 58, 60 are supported adjacent to the end wall 51 by insulating magnetic elements 64, 66, 68. A gas feed 70 introduces an ionizable gas into the ion chamber 48 through the end wall 51. A screen grid 72 and an accelerator grid 74, through which an ion beam 76 is extracted, are mounted on the end of the ion chamber 48 opposite the end wall 51.

The magnetic elements 56, 64, 66, 68 are electrically insulating permanent magnets, typically a ferrite material having a dc volume resistivity of at least 1000 ohm-centimeters. Ferrite materials can be fabricated in any desired shape by pressing and firing in a sintering process or by machining. The magnetic elements 56 provide a generally axial magnetic field along the cylindrical wall 50 with peripheral fields as indicated at 78 in FIG. 2. The magnetic elements 64, 66, 68 provide a magnetic field which is generally parallel to the end wall 51 with peripheral fields as indicated at 80. The magnetic fields enhance the ionization efficiency of the source by confining electrons to the central portion of the ion chamber 48.

The anodes 54, 58, 60 are conductive elements of a material which is compatible with the particular ionization process. One commonly used anode material is stainless steel. In accordance with the present invention, a preferred anode material is graphite. When graphite anodes are utilized, the sputtering and corrosion problems associated with stainless steel are eliminated.

Figure 3:
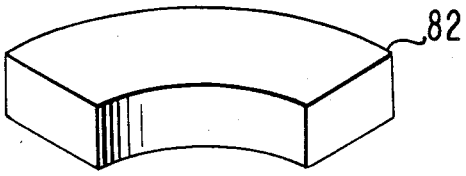
FIG. 3 is a perspective view of a magnet which can be used in the ion source shown in FIG. 2.

The magnetic elements 56 are shown in FIG. 2 as a plurality of layers positioned above and below each anode 54 so as to provide mechanical support for the anodes 54. Similarly, the magnetic elements 64, 66, 68 are shown as a plurality of layers positioned on opposite sides of the anodes 58, 60 so as to provide mechanical support therefor. In one preferred embodiment, each magnetic element 56, 64, 66, 68 includes several sector-shaped pieces 82 of appropriate dimension, as shown in FIG. 3. The sector-shaped pieces 82 can more easily be fabricated than a large annular ring of insulating magnetic material. The sector-shaped pieces 82 can be used to form a continuous annular ring of magnetic material in the ion source or can be spaced apart circumferentially around the ion source. Alternatively, single piece annular magnetic elements 56, 64, 66, 68 can be utilized. The magnetic elements 56 can be attached to the cylindrical wall 50 and the magnetic elements 64, 66, 68 attached to the end wall 51. Alternatively, the magnetic elements 56, 64, 66, 68 and the anodes 54, 58, 60 can be configured as self-contained assembly which slides into the ion chamber as a unit. The anodes 54 are spaced inwardly from the cylindrical wall 50 and the anodes 58, 60 are spaced inwardly from the end wall 51 to insure that there is no electrical contact between the anodes 54, 58, 60 and the walls 50, 51. During operation, the anodes 54, 58, 60 and the walls 50, 51 are maintained at different electrical potentials. In another configuration in accordance with the present invention, the magnetic elements 56, 64, 66, 68 are combined into a one-piece or a two-piece ion source magnet including means such as slots, grooves, or mounting holes, for mounting the anodes 54, 58, 60.

In the operation of the ion source, a reactive gas such as $CCl_4$ is provided to the ion chamber 48 through the gas feed 70. The gas is ionized by electrons emitted from the cathode 52 and accelerated toward the anodes 54, 58, 60. The magnetic field lines 78, 80 deflect high energy electrons away from the anodes 54, 58, 60, thereby increasing the number of ionizing collisions and improving ionization efficiency. A plasma, formed by the ions and electrons in the ion chamber 48, provides a source of ions for the ion beam 76. The ion beam 76 is extracted through apertures in the screen grid 72 and the accelerator grid 74 by application of appropriate voltages to the grids 72, 74. The voltages applied to the various electrodes of the ion source shown in FIG. 2 and described hereinabove are chosen to provide the desired operating characteristics. For example, the voltages can have the same magnitudes and polarities as the voltages applied to prior art ion sources. Furthermore, the magnetic fields produced by magnetic elements 54, 58, 60 are chosen to provide the desired operating characteristics. For example, the magnetic fields can have the same magnitudes and polarities as the magnetic fields in prior art ion sources.

Thus, there is provided by the present invention an ion source with simple construction, which is easy to manufacture and service and which is relatively inexpensive.

While there has been shown and described what is at present considered the preferred embodiment of the invention, it will be obvious to those skilled in the art that various changes and modifications may be made therein without departing from the scope of the invention as defined by the appended claims.

What is claimed is:

1. An electron-bombardment ion source comprising:

an ion chamber having electrically conductive chamber walls;

a cathode in said chamber for emitting electrons;

anode means in said ion chamber for accelerating and collecting electrons;

magnetic means in said ion chamber for producing a magnetic field which increases the ionization efficiency of said ion source, said magnetic means comprising an electrically insulating, permanently magnetized material which mechanically supports said anode means and electrically isolates said anode means from said chamber walls;

means for introducing an ionizable gas into said chamber; and means for accelerating ions out of said chamber.

2. The ion source as defined in claim 1 wherein said magnetic means has a dc volume resistivity greater than 1000 ohm-centimeters.

3. The ion source as defined in claim 2 wherein said electrically insulating, permanently magnetized material is a ferrite.

4. The ion source as defined in claim 1 wherein said anode means comprises graphite.

5. The ion source as defined in claim 1 wherein said ion chamber is cylindrical and said chamber walls include a cylindrical wall and an end wall, wherein said anode means includes a plurality of annular anode elements adjacent to and spaced apart from said cylindrical wall and said end wall and wherein said magnetic means includes portions interposed between said anode elements so as to form a layered structure adjacent to the cylindrical wall and the end wall of said ion chamber.

6. The ion source as defined in claim 5 wherein said magnetic means includes a plurality of sector shaped elements interposed between said annular anode elements.

7. The ion source as defined in claim 5 wherein said magnetic means includes a plurality of annular magnetic elements interposed between said annular anode elements.

8. In an electron-bombardment ion source of the type including an ion chamber having electrically conductive chamber walls, a cathode in said chamber for emitting electrons, anode means in said ion chamber for accelerating and collecting electrons, magnetic means in said chamber for producing a magnetic field which increases the ionization efficiency of said ion source, means for introducing an ionizable gas into said chamber and means for accelerating ions out of said chamber, the improvement comprising:

said magnetic means comprising an electrically insulating, permanently magnetized material which mechanically supports said anode means and electrically isolates said anode means from said chamber walls.

9. The improved source as defined in claim 8 wherein said magnetic means has a dc volume resistivity greater than 1000 ohm-centimeters.

* * * * *